United States Patent [19]

Luque

[11] Patent Number: 4,974,761

[45] Date of Patent: Dec. 4, 1990

[54] SLOT BAG, GAMBLING ACCESSORY

[76] Inventor: Irma J. Luque, 3843 W. Charter Oak Rd., Phoenix, Ariz. 85029

[21] Appl. No.: 350,319

[22] Filed: May 10, 1989

[51] Int. Cl.[5] ..... B65D 33/14; A45F 3/02; A45F 5/00

[52] U.S. Cl. ..... 224/148; 224/202; 224/235; 224/253

[58] Field of Search ..... 224/148, 151, 202, 235, 224/253, 258

[56] References Cited

U.S. PATENT DOCUMENTS

| | | | |
|---|---|---|---|
| 1,949,677 | 3/1934 | Crawford | 224/148 X |
| 2,464,069 | 3/1949 | Benson | 383/94 X |
| 3,578,225 | 5/1971 | Schroeder | 224/202 |
| 4,018,371 | 4/1977 | George | 224/148 |
| 4,401,245 | 8/1983 | Zills | 224/148 |
| 4,513,895 | 4/1985 | Leslie | 224/151 |
| 4,802,602 | 2/1989 | Evans et al. | 224/148 X |
| 4,815,640 | 3/1989 | Johnson | 224/202 |

*Primary Examiner*—Henry J. Recla
*Assistant Examiner*—Robert M. Fetsuga
*Attorney, Agent, or Firm*—James F. Duffy

[57] ABSTRACT

A slot bag gambling accessory which improves the operating methodology practiced in gambling establishments wherein coins for use with the gambling apparatus are provided to the customers in cups for transport about the gambling establishment. This improvement is a closeable pouch which may be worn in various modes about a person in order to transport the coin cup and the coins therein and to maintain the cup and the coins safe from pilferage and spillage and yet, conveniently at hand for use with the gambling machines.

20 Claims, 1 Drawing Sheet

U.S. Patent Dec. 4, 1990 4,974,761

SLOT BAG, GAMBLING ACCESSORY

BACKGROUND

1. Field of the Invention

The invention relates to gambling establishments having a slot machine and a coin cup for carrying coins to be used for playing the slot machine. Typically, the coin cup bears indicia bearing the name of the gambling establishment and having gambling symbolizing indicia imprinted thereon. In particular, the invention provides an improvement in the manner in which the gambling establishments's coin cup is transported about the establishment and the coins therein maintained in useful readiness but are sheltered from theft. Specifically, the invention relates to a closeable pouch which will fully enclose the coin cup which has means thereon for carrying the pouch securely on the person transporting the cup and having indicia imprint areas on the pouch for printing the name of the gambling establishment and gambling symbolizing indicia.

2. Prior Art

Persons who have played slot machines in a gambling establishment will be familiar with the practice of such establishment of placing coins in coin cups which the customers carry about from slot machine to slot machine when they are playing these machines. When a customer is playing a slot machine, he will typically set the cup down adjacent to the machine. In a crowded gambling casino, this arrangement leaves the cup open for easy pilferage. If the thief is not seen in the act it is difficult to accuse someone in the crowd of many, each holding the coin cup, of having stolen that cup. In this sense, the coin cups are fungible, being undifferentiated and impossible to identify one from the other.

Another source of concern in using the cups and allowing them to rest adjacent to the slot machine while the machine is being played is the possibility of jarring the cup and spilling the coins. It is the intention of the invention to provide means for improving the methodology practiced in a gambling establishment and to allow a customer to safely transport a coin cup so as to minimize the risk of pilferage and spillage.

SUMMARY OF THE INVENTION

The invention represents an improvement in a gambling establishment which has a slot machine, coins for playing a slot machine, and a coin cup for carrying coins about the gambling establishment. The improvement comprises a coin cup carrying enclosure for fully enclosing the coin cup so as to prevent loss and pilferage of coins within the cup. The enclosure has an accessible closure means so that access to the enclosure may be had to utilize the coins contained therein; and the enclosure may be safely closed thereafter. There are carrying means coupled to the enclosure so that the enclosure may be conveniently carried in a manner which will inhibit the theft of the coins or coin cup therein.

In a preferred embodiment of the invention the enclosure is made of a soft pliable material and the accessible closure means comprises a draw-string closure. The carrying means of the enclosure is designed to permit the enclosure to be worn on the person. In a preferred embodiment of the invention, the carrying means comprises a strap which is adjustable in length and which permits a person to wear the enclosure about that person's neck, shoulder, or waist. As a convenience for carrying paper money the enclosure includes a pocket. While illustrated herein as an external pocket, it is anticipated that the pocket may be coupled to an inside wall of the enclosure for greater safety.

To further distinguish the invention, the enclosure has an indicia imprint area for imprinting such indicia a may be selected by the management of the gambling establishment. A first indicia imprint area will have imprinted thereon indicia selected by the gambling establishment to identify the enclosure as a gambling accessory. A second indicia impint area will have indicia imprinted thereon, as selected by the gambling establishment, to associate the enclosure with the gambling establishment itself, e.g., the name of the gambling establishment or the like.

A DETAILED DESCRIPTION OF THE INVENTION

Figure 1:
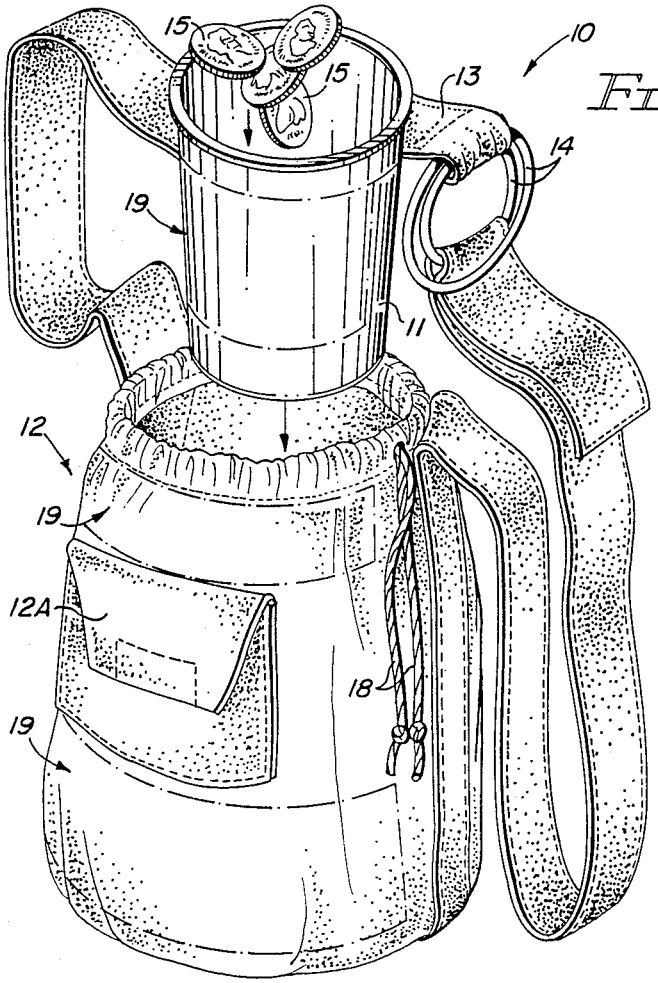
FIG. 1 is a perspective view of the invention illustrating it as a draw-string pouch into which a coin cup with coins therein is about to be emplaced. An adjustable strap is provided so as to permit the pouch to be worn on the person carrying the coin cup.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Carrying a coin cup about in a gambling casino can be a nuisance. There is no convenient place to rest the cup without fear of its being taken or having the coins spilled. If one is not actually playing a slot machine, one's hand is always occupied carrying the cup. The cup intrudes on every action, for example, eating, drinking, or just plain relaxing. The slot bag 10, shown in FIG. 1, is a gambling accessory designed to eliminate these problems. Slot bag 10 is designed to accept and retain, in a safe and transportable manner, a coin cup 11.

Coin cups 11 are provided by gambling establishments to carry coins 15 therein for purposes of playing slot machines within the gambling establishment. In any particular gambling establishment, the coin cups provided will have an indicia imprint area 19 wherein the name of the gambling establishment is imprinted, for example, CIRCUS CIRCUS. Frequently, other gambling symbolizing indicia are also imprinted on the cup, for example, rolling dice or a winning slot machine display.

Slot bag 10 is comprised of a pouch 12 which fully and safely encloses coin cup 11 and the coins 15 therein.

The purpose of carrying the coin cup and its coins within pouch 12 is to provide an easy means of transport of the cup while maintaining the cup and the coins therein within convenient reach but safe from pilferage. When a person is not actively employed in utilizing the coins 15 for purposes of gambling, draw-string 18 provide added safety by permitting the pouch 12 to be securely closed so that access to cup 11 and coins 15 is inhibited.

As an added convenience for carrying paper money, driver's license or incidental, items enclosure pocket 12A is supplied coupled to pouch 12. Although shown, for illustrative purposes, coupled to the outside of pouch 12, enclosure pocket 12A may be coupled to the interior of pouch 12 to provide added safety to the items stored therein.

To make it easy to carry slot bag 10 about the person, a strap 13 is attached to pouch 12. Means for adjusting the length of strap 13, for example, rings 14, are also provided to adjust the strap length to the person wearing the slot bag and to accommodate the various styles in which the bag may be worn.

Like coin cup 11, pouch 12 bears indicia imprinting areas 19 which permit the gambling establishment to imprint its name on pouch 12 and to indicate, with indicia symbolic of gambling, the fact that slot bag 10 is indeed a gambling accessory specifically advocated for use in gambling within the gambling establishment whose name is imprinted on pouch 12 within an indicia imprint area 19.

Figure 2:
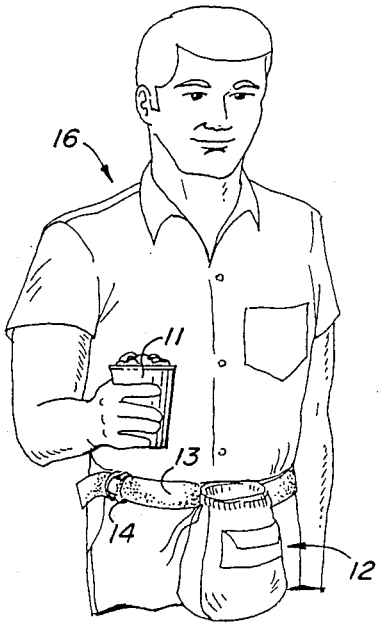
FIG. 2 illustrates a person wearing the pouch about his waist and about to deposit a coin cup therein.

In FIG. 2, a person 16 is shown wearing pouch 12 with strap 13, adjusted by means 14 to fit about the person's waist. As illustrated, the person is about to emplace coin cup 15 into pouch 12 where it may be conveniently transported and the coins be made readily available.

Figure 3:
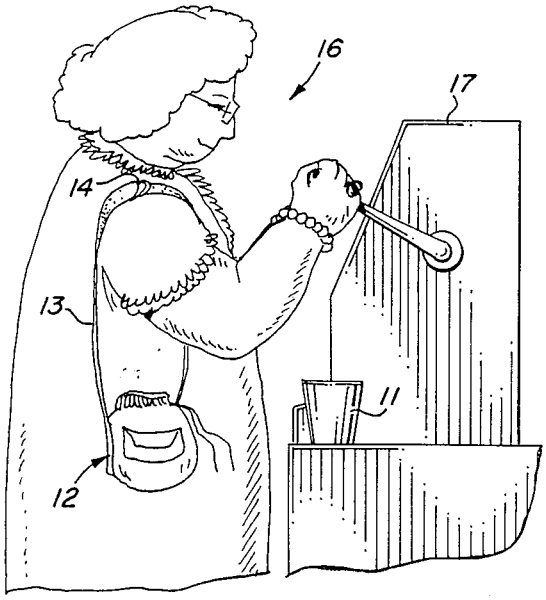
FIG. 3 illustrates both the slot bag pouch worn over a person's shoulder as well as the prior art method of resting a coin cup adjacent to the slot machine.

In FIG. 3 a person 16 is shown operating a slot machine 17. A coin cup 11 is shown resting adjacent slot machine 17. It is easily seen how vulnerable to pilferage coin cup 11 is when left in such position as well as the danger it is exposed to being jarred so as to tip and spill the coins it contains. The coin cup 11 could be more conveniently and safely carried within pouch 12 which is being worn over the shoulder of the person 16, supported there by means of strap 13.

Figure 4:
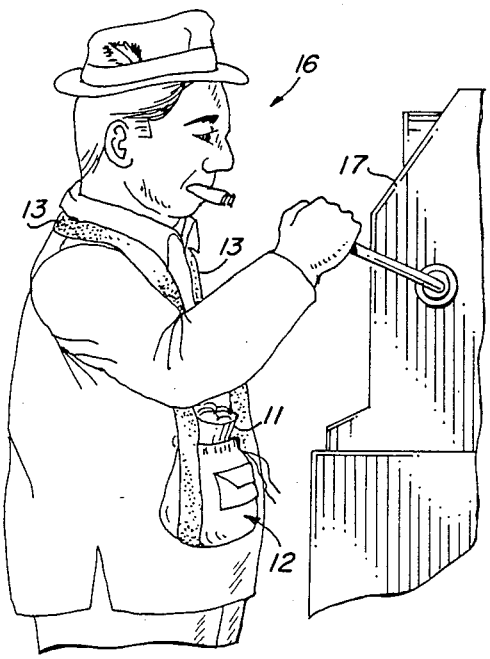
FIG. 4 illustrates a person utilizing the coin pouch, worn about his neck, while playing a slot machine. The exposure of the coins in the coin cup in the drawing has been exaggerated for purposes of exposition.

The person 16 shown in FIG. 4 is wearing pouch 12 with strap 13 emplaced about his neck. Coin cup 11 with coins 15 therein has been emplaced in the pouch for convenience of carrying and having coins 15 readily at hand for playing slot machine 17. For purposes of illustration the cup 11 and the coins 15 therein have been shown in FIG. 4 with greater exposure than will actually be experienced and practiced.

FIGS. 2, 3 and 4 illustrate variations in the manner in which slot bag 10 with its draw-string pouch 12 may be carried and worn about the person. Not illustrated, but recommended, is a bottom stiffening element to maintain the shape of the bottom of pouch 12 and to aid in supporting cup 11 therein. A water imprevious support element is suggested so that slot bag 10 may be laundered without deterioration of the supporting element.

What has been disclosed is a slot bag gambling accessory which improves the operating methodology practiced in gambling establishments wherein coins for use with the gambling apparatus are provided to the customers in cups for transport about the gambling establishment. This improvement is a closeable pouch which may be worn in various modes about a person in order to transport the coin cup and the coins therein and to maintain the cup and the coins safe from pilferage and spillage and, yet, conveniently at hand for use with the gambling machines.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. In a gambling establishment having a slot machine, coins for playing said slot machine, and a coin cup for carrying said coins about said gambling establishment, the improvement comprising:

a coin cup carrying enclosure for fully enclosing said coin cup to prevent loss and pilferage of said coins;

accessible closure means coupled to said enclosure for providing selected access to and closure of said enclosure; and carrying means coupled to said enclosure for conveniently carrying said enclosure with said coins and coin cup therein and inhibiting the theft thereof.

2. The improvement of claim 1 further comprising a convenience pocket coupled to said enclosure.

3. The improvement of claim 1 wherein said enclosure is made of a soft, pliable material.

4. The improvement of claim 3 wherein said accessible closure means comprises a draw-string closure.

5. The improvement of claim 4 further comprising a convenience pocket coupled to said enclosure.

6. The improvement of claim 5 further comprising an indicia imprint area on said enclosure for imprinting indicia selected by said gambling establishment.

7. The improvement of claim 6 wherein said indicia imprint area comprises a first imprint area for imprinting indicia selected by said gambling establishment for identifying said enclosure as a gambling accessory.

8. The improvement of claim 7 wherein said indicia imprint area further comprises a second imprint area for imprinting indicia selected by said gambling establishment for associating said enclosure with said gambling establishment.

9. The improvement of claim 1 further comprising an indicia imprint area on said enclosure for imprinting indicia selected by said gambling establishment.

10. The improvement of claim 9 wherein said indicia imprint area comprises a first area for imprinting indicia selected by said gambling establishment for identifying said enclosure as a gambling accessory.

11. The improvement of claim 10 wherein said indicia imprint area further comprises a second imprint area for imprinting indicia selected by said gambling establishment for associating said enclosure with said gambling establishment.

12. The improvement of claim 9 further comprising a convenience pocket coupled to said enclosure.

13. The improvement of claim 1 further comprising carrying means coupled to said enclosure for carrying said enclosure worn on a person.

14. The improvement of claim 13 further comprising a convenience pocket coupled to said enclosure.

15. The improvement of claim 13 wherein said carrying means comprises a strap for wearing about at least one of a person's neck, shoulder and waist.

16. The improvement of claim 15 further comprising an indicia imprint area on said enclosure for imprinting indicia selected by said gambling establishment.

17. The improvement of claim 13 further comprising an indicia imprint area on said enclosure for imprinting indicia selected by said gambling establishment.

18. The improvement of claim 17 wherein said indicia imprint area comprises a first imprint area for imprinting indicia selected by said gambling establishment for identifying said enclosure as a gambling accessory.

19. The improvement of claim 18 wherein said indicia imprint area further comprises a second imprint area for imprinting indicia selected by said gambling establishment for associating said enclosure with said gambling establishment.

20. The improvement of claim 17 further comprising a convenience pocket coupled to said enclosure.

* * * * *